US006109226A

United States Patent [19]

Mote, Sr.

[11] Patent Number: 6,109,226

[45] Date of Patent: Aug. 29, 2000

[54] GEARED ROCKER VALVE OPERATION FOR INTERNAL COMBUSTION RECIPROCATING PISTON ENGINES WHICH INCORPORATE AN OVERHEAD CAM

[75] Inventor: Charles R. Mote, Sr., 2529 W. Poppy Ave., Tucson, Ariz. 85705

[73] Assignee: Charles R. Mote, Sr., Tucson, Ariz.

[21] Appl. No.: 08/897,122

[22] Filed: Jul. 18, 1997

Related U.S. Application Data

[63] Continuation-in-part of application No. 08/600,481, Feb. 13, 1996, Pat. No. 5,732,670.

[51] Int. Cl.[7] ..... F01L 1/30

[52] U.S. Cl. ..... 123/90.24; 123/90.39

[58] Field of Search ..... 123/90.24, 90.25, 123/90.26, 90.27, 90.39, 90.41, 90.42, 90.44

[56] References Cited

U.S. PATENT DOCUMENTS

| | | | |
|---|---|---|---|
| 2,015,135 | 9/1935 | Brady | 123/90.24 |
| 2,814,283 | 11/1957 | Gassmann et al. | 123/90.24 |
| 2,831,470 | 4/1958 | Lorscheidt | 123/90.24 |
| 2,833,258 | 5/1958 | Lorscheidt et al. | 123/90.24 |
| 3,430,614 | 3/1969 | Meacham | 123/90.24 |
| 3,585,974 | 6/1971 | Weber | 123/90.24 |
| 3,626,469 | 12/1971 | Ashley | 123/90.25 |
| 4,928,650 | 5/1990 | Matayoshi et al. | 123/90.24 |

OTHER PUBLICATIONS

Design of Racing and High Performance Engines ©1995 By:Society of Automotive Engineers p. 102.

*Primary Examiner*—Weilun Lo

[57] ABSTRACT

An improved design for valve operation in internal combustion type engines which incorporate an overhead cam. This invention eliminates the valve spring. In current engines of this type an overhead cam lobe provides the force to the system to open an intake or exhaust valve and a compressed valve spring provides the stored energy to force the valve back closed. This invention uses two cam lobes on an overhead cam 15, an open cam lobe 16 and a close cam lobe 17; and two geared rockers, a open valve rocker 19 and a close valve rocker 20. A valve stem retainer assembly 12 is required to always engage the valve during operation. Positive force from the lobes of the overhead cam shaft is used to both open and close an intake or exhaust valve. The key is that only one of the cam shaft lobes drives the system at a time. If the close valve cam lobe 17 is providing the force to close the valve then the open valve cam lobe 16 is not engaged with the cam. Likewise, if the open valve cam lobe 16 is actively driving the roller on the open valve rocker 19, then the close valve cam lobe 17 is not engaged. Since the open and close valve rockers are geared and engaged into each other, the rocker that is not driving the system at any given time, is being driven by it.

9 Claims, 4 Drawing Sheets

GEARED ROCKER VALVE OPERATION FOR INTERNAL COMBUSTION RECIPROCATING PISTON ENGINES WHICH INCORPORATE AN OVERHEAD CAM

This patent application is a continuation-in-part of Ser. No. 08/600,481, now U.S. Pat. No. 5,732,670 which is titled "Geared Rocker Valve Operation for Internal Combustion Reciprocating Piston Engines" filed Feb. 13, 1996.

BACKGROUND—FIELD OF INVENTION

The field of this invention is in geared intake and exhaust valve operation in internal combustion reciprocating piston engines from an overhead cam.

BACKGROUND—DESCRIPTION OF PRIOR ART

U.S. Pat. No. 5,732,670 is related to the use of a pair of geared rockers, a pair of lifters, and two cam lobes per valve in order to positively actuate a single valve in an internal combustion reciprocating piston engine. The use of valve springs was eliminated. Additionally, the valve stem was attached to the end of one of the rocker arms by a retainer mechanism.

This previous patent introduced above, only covered the use of the geared rocker combination as driven from a pair of lifters and pushrods riding on a centralized cam shaft located directly above the crankshaft. However, by modifying the rocker design, and using an overhead cam, the need for lifters and pushrods is eliminated. This results in a completely different engine design with fewer components thus increasing engine reliability and performance. Typical overhead cam engines use valve springs to close the valves, and a single cam lobe which engages a single rocker on one end. The other end of the rocker then presses against the top of the valve stem to open the valve. The stored energy held in the compressed valve spring must then force the valve to a closed position.

As discussed in U.S. Pat. No. 5,732,670; the benefits of eliminating the use of valve springs in internal combustion engines are many. This is especially true when the engine is a high performance engine used for racing. The use of valve springs reduces the power output of the engine, due to the force required to compress the valve spring as the valve opens. Using a geared approach, there is no loss of horsepower due to spring compression. Also, when engines using valve springs turn at a high rate of speed, the valve springs will often experience lash causing the valves to float, because the spring is not strong enough to close the valve and keep the lifter flush against the camshaft as it travels down the backside of the cam shaft lobe. When a valve floats, it is left protruding into the combustion chamber during the upward stroke of the piston which may result in total destruction of the engine. In high performance engines, much stronger valve springs are used in an effort to combat this problem. However, stiffer valve springs greatly increase the rate of metal fatigue in the spring which causes rapid valve spring failure, which is one of the primary causes of engine failure (particularly in the high performance environment).

Once the valve springs have been eliminated, a significant increase in engine reliability and performance may be achieved. At this point, incremental increases to reliability and performance may be obtained through design improvements and component reduction. With respect to U.S. Pat. No. 5,732,670 this invention eliminates several components by driving the geared rockers directly from an overhead cam (OHC), Whereas previously, the two geared rockers were driven from a cam located in the usual position directly over the crankshaft in the center of the engine. In this previous configuration, two lifters and two pushrods were required to transfer the energy from the lobes of the camshaft to the geared rockers. However, if the camshaft is located directly beside the pair of geared rockers inside of the cylinder head area, then a pair of lifters and a pair of pushrods are no longer required to transfer the energy to the geared rockers.

To summarize, valve springs severely limit an engine's performance and life-span. Using a geared rocker pair driven from a central cam shaft is a vast improvement over the use of valve springs. It enables a standard engine to be retrofitted in order to eliminate the use of valve springs, and provides a means to eliminate components so that improved engine reliability may be achieved.

OBJECTS AND ADVANTAGES

This invention improves the operation of valves in an internal combustion reciprocating piston engine by eliminating the requirement for valve springs. Several objects and advantages of this invention are:

a. To provide for positive valve actuation without the need for valve springs, with the following advantages:

1. Increased reliability (fatigue induced valve spring failure will no longer occur thus reducing the likelihood of engine destruction).
2. Increased performance due to the increased operational speeds that are obtainable without valve springs (valve lash and floating will no longer be a problem). Only the mechanical inertia and strength of the components will limit the maximum speeds attainable.
3. Increased performance since both the opening and closing acceleration and timing of the valve may be accurately controlled. With positive valve opening and closing, the valve may remain open longer and close faster which results in increased horsepower.
4. Increased convenience due to the decreased amount of maintenance that is required when valve springs are not used. Changing valve springs out after each race will no longer be required.

b. To provide a more reliable and simple design. For example:

1. Increased reliability due to fewer components. The need to incorporate two lifters and two pushrods is eliminated by driving the geared rocker pair directly off of an overhead cam.
2. Increased strength of design since no lifters and pushrods are required. These two components are typically more fragile than the geared rockers.

c. To provide a means for overhead cam engines to gain the benefits of operation without valve springs.

This invention offers a means of positively actuating a valve from a geared rocker pair driven directly from an overhead cam shaft so that no valve springs are required. In engines which are designed for overhead cams, this invention provides a means to obtain a significant improvement in engine performance and reliability. As compared to engines which incorporate a single cam shaft directly above the crankshaft and use a geared rocker approach, this invention eliminates the need to have two lifters and two pushrods per valve. Additionally, this invention should reduce the cost of maintaining engines since fragile valve springs will no longer be used.

DRAWING FIGURES

In the drawings, closely related figures have the same number but different alphabetic suffixes.

Figure 3A:
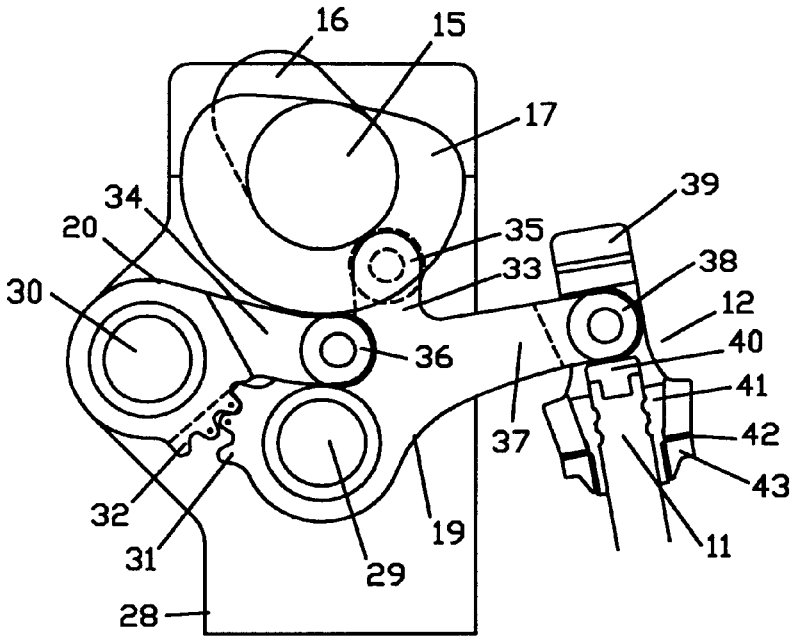
Figure 3B:
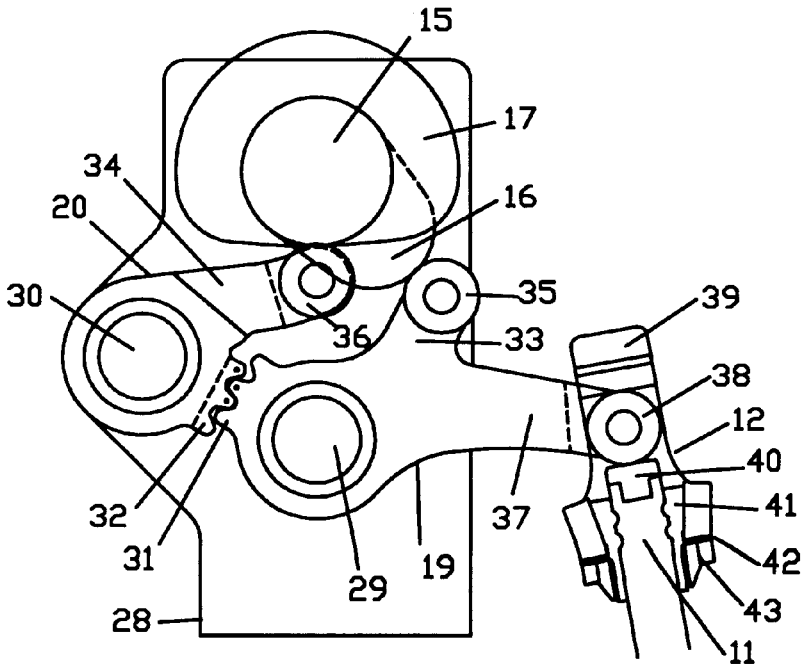

FIGS. 3A and 3B show the geared rocker assembly opening and closing an exhaust or intake port valve. These two figures are close-ups of the area directly under the rocker cover in FIG. 1. Since the valve operation is identical for both the exhaust and intake ports of a cylinder, no distinction between the two is made in this figure.

Figure 4:
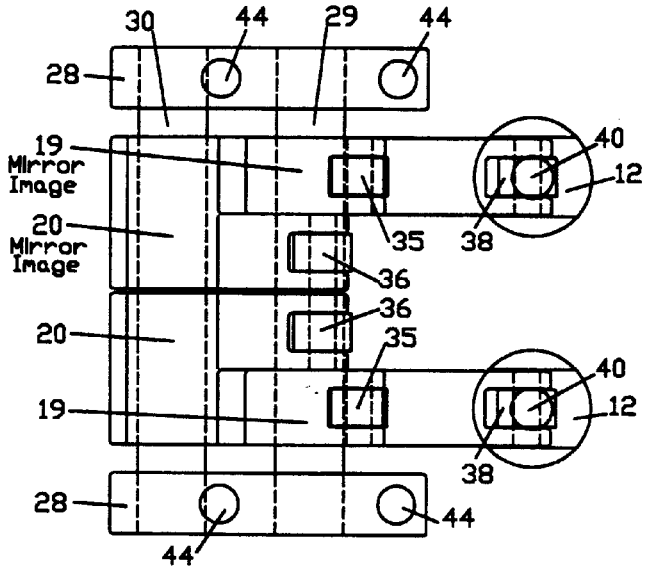
Figures 1, 5A:
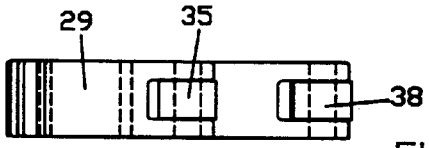
Figures 2, 5A:
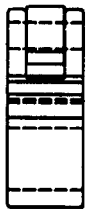
Figures 3, 5A:
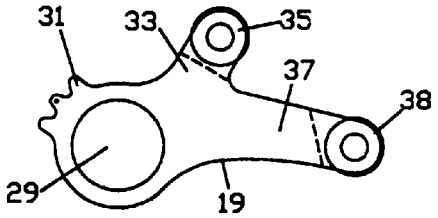

FIG. 4 is a top view of the assembly of FIG. 3, with the addition that the top view of the exhaust valve assembly has been included as well. As seen in this top view, the exhaust valve assembly is an identical mirror image of the intake valve assembly. However, the exhaust valve assembly could just as easily have been identical to the intake valve assembly and not mirrored.

Figures 1, 5B:
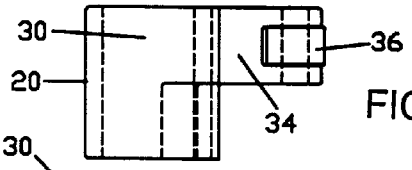
Figures 2, 5B:
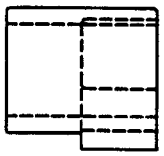
Figures 3, 5B:
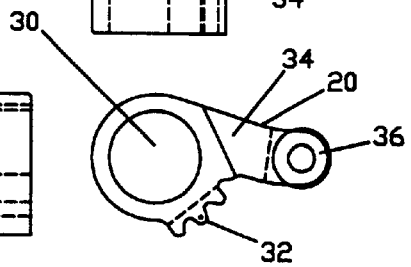

FIGS. 5A and 5B are close-ups of the open valve geared rocker and the close valve geared rocker respectively.

REFERENCE NUMERALS IN DRAWINGS

1. oil pan
2. crankshaft
3. connecting rod
4. usual location of the cam shaft
5. cylinder
6. piston
7. exhaust pipe
8. intake port
9. valve head
10. valve stem
11. top of valve stem
12. valve stem retainer assembly
13. fuel injectors
14. velocity stacks
15. overhead cam shaft
16. open valve cam lobe
17. close valve cam lobe
18. rocker cover
19. open valve rocker
20. close valve rocker
21. drive gear
22. idler gear
23. idler
24. toothed belt drive
25. guide pulley
26. cam shaft drive belt
27. toothed pulley
28. stand
29. open valve rocker shaft
30. close valve rocker shaft
31. open valve rocker gear teeth
32. close valve rocker gear teeth
33. open valve rocker cam arm
34. close valve rocker cam arm
35. open valve rocker cam roller
36. close valve rocker cam roller
37. open valve rocker retainer arm
38. open valve rocker retainer roller
39. hardened retainer top plate
40. hardened valve stem cap
41. keeper
42. washer
43. nut
44. stand screw

DESCRIPTION—FIGS. 1 THROUGH 5B

Figure 1:
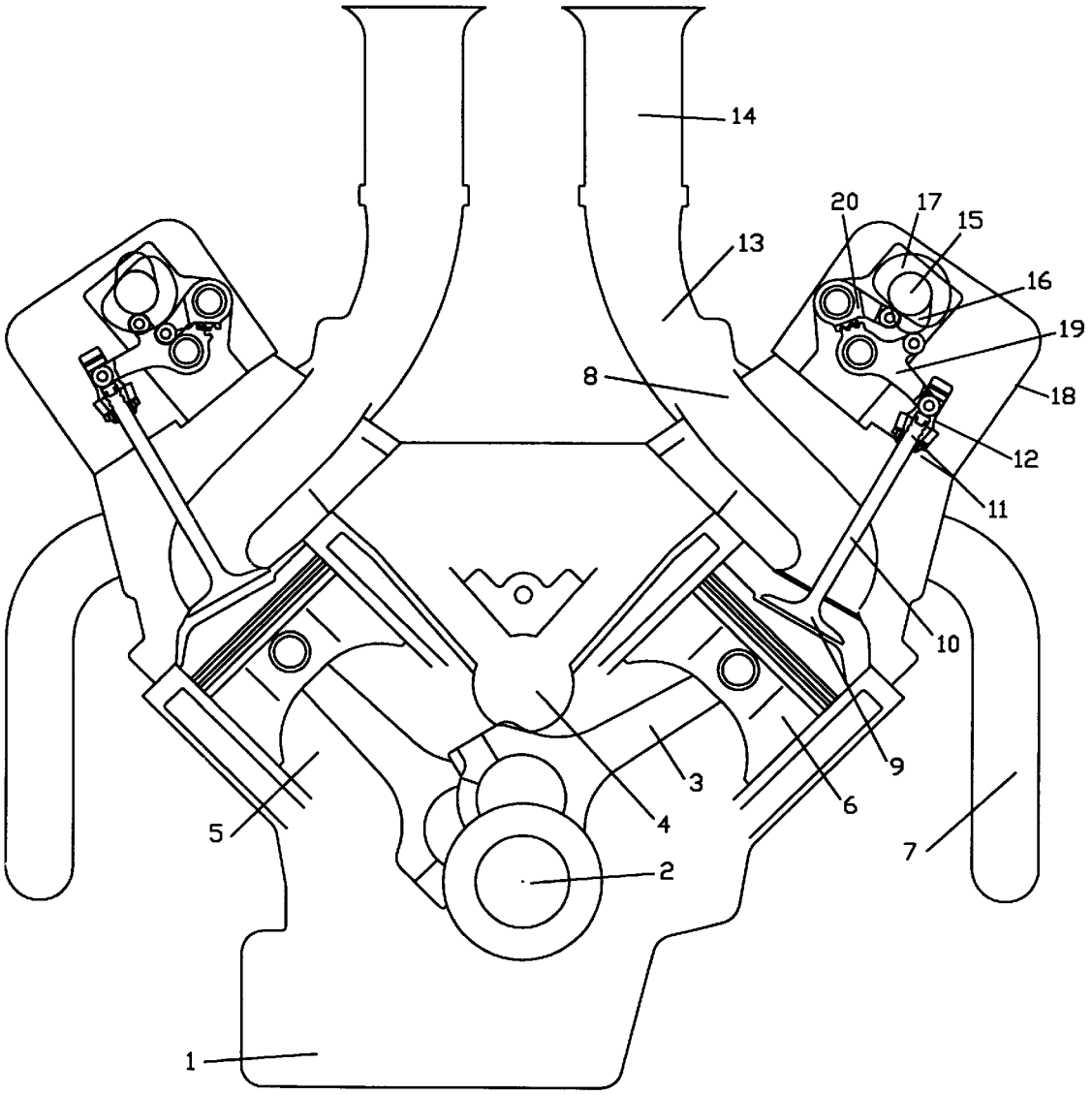
FIG. 1 illustrates what an engine would look like which was built using this invention. It's primary purpose is to put the invention in perspective relative to a typical internal combustion reciprocating piston engine with an overhead cam design.

FIG. 1 shows a cross section of an internal combustion reciprocating piston type engine with overhead cams which incorporates this invention. Although only the intake port valves and related operational components are shown in this view, the exhaust ports are similar and their operational components are identical mirror images of the intake port components. Many basic components of an overhead cam engine are shown in this figure such as: an oil pan 1, a cylinder 5, a crankshaft 2, a connecting rod 3, a piston 6, and an exhaust pipe 7. In this view, the approximate location of the fuel injectors 13 and the velocity stacks 14 are also shown. However, the engine could just as well be carbureted, in which case a carburetor would replace both the fuel injectors and stacks. Since this is a overhead cam engine, the usual location of the cam shaft 4, is not used but rather a overhead cam 15 is used for both the right and left side of the engine. Since this view illustrates the components required to operate the intake port, only the intake port 8 is shown. However, the exhaust port could have just as easily been shown instead since operation of the two is identical. A valve stem 10 and the valve head 9 are also shown. The top of the valve stem 11 is held onto at all times by the valve stem retainer assembly 12. The overhead cam 15 has both a open valve cam lobe 16, and a close valve cam lobe 17. The open valve cam lobe is responsible for actuating the open valve rocker 19 just as the close valve cam lobe 17 is responsible for actuating the close valve rocker 20.

Figure 2:
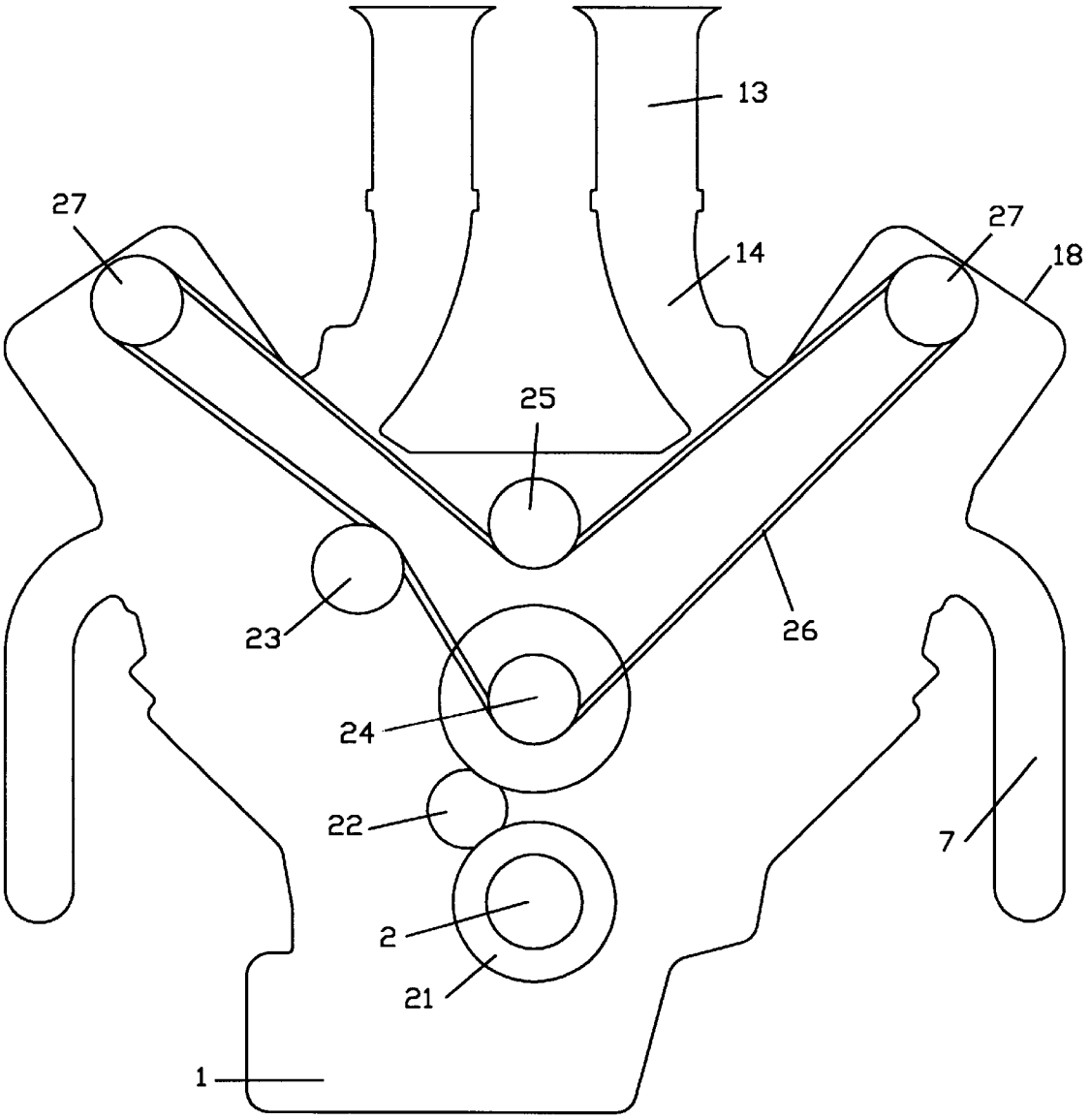
FIG. 2. PRIOR ART
FIG. 2 is a prior art illustration of how a overhead cam is typically driven from the crankshaft in a internal combustion reciprocating piston engine.

FIG. 2 is a prior art depiction of how a overhead cam is typically driven from the crankshaft of an engine. Once again, several items are shown for reference purpose only such as: the oil pan 1, the exhaust pipes 7, the rocker covers 18, the fuel injectors 14, and the stacks 13. The crankshaft 2 contains a drive gear 21 which engages a idler gear 22, which in turn engages a toothed belt drive 24. The toothed belt drive 24 engages the cam shaft drive belt 26. An idler 23, and a guide pulley 25, also press against the belt. The belt engages the two overhead cam shafts 27 which are responsible for driving the valves on both the left and right sides of the engine.

FIGS. 3A and 3B illustrate the primary embodiment of this invention. FIG. 3A shows the position of the valve operating components when the valve is forced closed. FIG. 3B shows the position of these same components when the valve is being forced open. The top of the valve stem 11 is grooved and is forcibly held in place at all times by a valve stem retainer assembly 12. This assembly contains a keeper 41 which snugly fits into the groves found at the top of the valve stem. The keeper 41 is locked into place by a nut 43 and a washer 42 which threads onto the keeper. A hardened retainer top plate 39, in conjunction with a hardened valve stem cap 40, keep the open valve rocker retainer roller 38 firmly confined at all times during the operation of the valve. The roller may move back and forth along the flat hardened surfaces, but very tight tolerances are kept vertically between the hardened surfaces so that the roller does not have significant play up and down. This is important since this tolerance directly effects how well the valve closes.

Although hardened steel is recommended, any hardened material may be used so that the open valve rocker retainer roller 38 does not wear into the surfaces of the valve stem 11 or the hardened retainer top plate 39. The open valve rocker 19 has an open valve retainer arm 37 which holds the open valve rocker retainer roller at it's end. The open valve rocker pivots around the open valve rocker shaft 29. The open valve rocker contains a open valve rocker cam roller 35 which is located at the end of the open valve rocker cam arm 33. While the valve is opening, this open valve rocker cam roller 35 rides smoothly along the surface of the open valve cam lobe 16. While the valve is closed, there may a few thousandth's of an inch gap between the two. Likewise, the close valve rocker 20 contains a close valve rocker cam roller 36 which is located at the end of the close valve rocker cam arm 34. While the valve is closing or is closed, this close valve rocker cam roller 36 rides smoothly along the surface of the close valve cam lobe 17. However, while the valve is open, there may be a few thousands of a gap between the two. The close valve rocker rotates about the close valve rocker shaft 30. At all times, the open valve rocker gear teeth 31 and the close valve rocker gear teeth 32 are positively engaged. This forces a strict interdependency between both the open valve rocker 19 and the close valve rocker 20. Therefore, only one of the rockers may drive the combination at a time. A stand 28 is located between each cylinder of the engine in order to support all of the rocker components and optionally, the overhead cam itself.

FIG. 4 shows a top view of the assembly required to operate both the intake and exhaust port valves for a singe cylinder minus the overhead cam shaft. Since the rocker pair required for the exhaust port are an identical mirror image of the rocker pair required to operate the intake port, only the intake port pair have been shown in the previous side views. Alternatively, the exact same rocker pair could be used to open the exhaust port as is used to open the intake port. In this case, the lower half of FIG. 4 would look identical to the upper half of FIG. 4 rather than appearing as a mirror image. Either way would work just as well as the other. In FIG. 4 both the open valve rocker shaft 29 and the close valve rocker shaft 30 for a single cylinder assembly are shown as supported by a pair of stands 28. Each stand is held in place against the engine block by a pair of stand screws 44. The position of both the open valve rocker cam roller 35 and the open valve rocker retainer roller 38 are shown in the open valve rocker 19. Likewise, the position of the close valve rocker cam roller 36 is shown in the close valve rocker 20. At the end of the open valve rocker 19, is the top view of the valve stem retainer assembly 12, and a top view of the hardened valve stem cap 40 which is inserted into the top of the valve stem 11.

FIGS. 5A and 5B show the individual valve rockers in greater detail. In FIG. 5A a open valve rocker 19 is shown. This rocker has a open valve rocker retainer roller 38 located at the end of a open valve rocker retainer arm 37. This roller is what engages the valve stem retainer assembly 12 (shown in previous drawings), in order to transfer the opening and closing motion to the valve with as little friction as possible. The open valve rocker 19 also contains a open valve rocker cam roller 35 located at the end of a open valve rocker cam arm 33. This roller is made to ride along the surface of the open valve cam lobe 16 (shown in previous figures) with as little friction as possible. The entire open valve rocker rotates about the open valve rocker shaft 29. Additionally, this rocker contains several open valve rocker gear teeth 31. In FIG. 5B a close-up of the close valve rocker 20 is shown. This rocker contains a close valve rocker cam roller 36 located at the end of a close valve rocker cam arm 34. This roller is made to ride along the close valve cam lobe 17 (shown in previous figures) with as little friction as possible. The close valve rocker gear teeth 32 are designed to fit perfectly into the open valve rocker gear teeth 31 of FIG. 5A. Although these rockers are typically made of hardened steel, any high strength material such as ceramics, titanium, or alloys would work perfectly well.

From the description above, a number of advantages of this invention become evident.

A. Most engines which incorporate the use of an overhead cam could be modified to greatly benefit from this invention. Also, overhead cam engines built from the ground up could easily be designed to use this invention with very little changes to the existing production line. Therefore, many people could benefit from this invention in the present and in the future.

B. The new valve operating assembly does not require valve springs and should increase performance and reliability. Typically, a design with fewer components is more reliable. This invention eliminates the need for both lifters and pushrods.

C. Engine speed and performance will not be limited by the operating characteristics of the valve spring. Now only the inertial mass and strength of the components will limit the performance attainable.

D. Race engines incorporating this invention will have enhanced performance. Positive valve opening and closing will enable the valve to remain open longer and close faster, generating more horse power and supporting higher RPM ranges.

F. Engines incorporating this invention will require less maintenance than those that use valve springs. This is especially true for high performance race engines.

OPERATION—FIGS. 1 TO 5

The operation of this geared rocker internal combustion engine is such that a valve spring is no longer required and therefore the engine performance is greatly enhanced. Since this invention is operated from an overhead cam rather than a centralized cam shaft located directly above a crankshaft, the need for lifters and pushrods has also been eliminated.

First, a quick discussion of how overhead cam engines are typically driven off of the crankshaft. As seen in FIG. 2 which is prior art, the crankshaft 2 has a drive gear 21 which engages a idler gear 22. The idler gear 22 in turn engages a toothed belt drive 24. The toothed belt drive 24 drives the cam shaft drive belt 26. Therefore, the speed of the cam shaft drive belt is directly dependent on the revolution speed of the crankshaft 2. The location of an idler 23 is adjustable so that the tension in the cam shaft drive belt 26, may be correctly set. A guide pulley 25 also makes contact with the cam shaft drive belt 26, and does not forcibly engage it. Its purpose is to control the travel path of the cam shaft drive belt so that it will reach both overhead cam shafts 27 without interference with other engine components. The overhead cam shafts 27 are geared so that their speed is precisely controlled by the cam shaft drive belt 26, and thus ultimately by the speed of the crankshaft 2. By maintaining a precise speed relationship between the crankshaft 2 and the overhead camshafts 27, it is ensured that the intake and exhaust valves will open and close at precisely the correct time in relation to the pistons travel in the cylinder. As seen in FIG. 1, the position of the piston 6 within the cylinder 5, is controlled by the crankshaft 2. This is due to the fact that the piston 6 is connected to an arm of the crankshaft 2 by a connecting rod 3.

In overhead cam engines using valve springs, a single cam lobe pushes the valve open (generally by means of a single rocker) and simultaneously compresses a valve spring in the process. The energy stored in the compressed valve spring must be sufficient to close the valve from its open position and press the single rocker back flush against the cam lobe. Since a valve spring can only store a limited amount of energy which is required to close the valve, the operational speed of an engine is significantly limited. If a valve spring can't close a valve fast enough, the valve may be left inside the cylinder and may be destroyed by an upward stroke of the piston. High performance engines typically use much stiffer valve springs in an effort to combat this problem. However, since these are brittle, they fatigue and fail quickly. This invention eliminates valve springs, providing a way to drive the valve open and closed directly off of the overhead cam shaft.

Basic embodiment of operation: Although FIG. 1 shows the paired rocker assembly positioned relative to an engine cross-section. FIGS. 3A and 3B will be used to describe in detail the operation of this invention. This is preferable since FIGS. 3A and 3B are really just a close-up taken directly out of the overhead cam areas of FIG. 1.

FIG. 3A shows the geared rocker pair being driven from the overhead cam shaft 15 to close a valve, and FIG. 3B shows the geared rocker pair being driven to open the valve. It is important to note that the valve may be either an intake port valve or an exhaust port valve since the geared operation to open and close either one is identical. Also, one must keep in mind that the camshaft is rotating in a counter clockwise (CCW) direction. Additionally, the open valve rocker 19 pivots around the open valve rocker shaft 29 just as the close valve rocker 20 pivots around the close valve rocker shaft 30. Beginning with FIG. 3A, the valve is actively being driven into a closed position. The closed valve cam lobe 17 is forcibly pressing against the close valve rocker cam roller 36. In the still frame view of FIG. 3A the close valve rocker cam arm 34 (and thus the entire close valve rocker 20) has been forced into its lowest position possible. In other words, the close valve rocker 19 cannot be driven any further in a CW rotation. Remember that the entire close valve rocker 20 pivots around the close valve rocker shaft 30. Since the close valve rocker gear teeth 32 have forcibly engaged the open valve rocker gear teeth 31, the open valve rocker has been forced to rotate CCW to its furthest most upward position. The force exerted on the open valve rocker gear teeth at this point, is the only force which controls the rotational position of the of the open valve rocker 19. Now the open valve rocker cam roller 35 is just short of coming in contact with the backside of the open valve cam lobe 16 by a few thousandths of an inch. Therefore, the entire geared rocker assembly, including valve stem 11, is being positioned and driven by the close valve rocker cam roller 36 riding along the close valve cam lobe 17. Since the open valve rocker 19 is being forced into its upper most position by its gear engagement into the close valve rocker 20, the open valve rocker retainer arm 37 and open valve rocker retainer roller 38 are also in their uppermost CCW position. Therefore, the valve stem retainer assembly 12 and the top of the valve stem 11 are also in their uppermost position. By pulling the top of the valve stem upward as far as possible, the valve head 9 (as seen in FIG. 1) is pulled up flush against the port in the cylinder 5 (also seen in FIG. 1) thus completely closing the port.

This valve close position described above is maintained as long as the close valve rocker cam roller 36 continues to roll along the wide portion of the close valve cam lobe 17. However, as the close valve rocker cam roller 36 begins to roll down the decline portion of the close valve cam lobe 17, the entire close valve rocker 20 begins to rotate CCW. Due to the geared nature of the two rockers, the open valve rocker 19 is then forced to begin rotating CW about its open valve rocker shaft 29 thus causing the open valve rocker retainer arm 37 and roller 38 to travel downwards. Since the valve stem retainer assembly 12 holding the top of the valve stem 11 engages the open valve rocker retainer roller 38, it also begins to move downward thus opening the valve into the port.

A key point of interest in the operation of the geared rocker pair is when the valve just starts to move into the cylinder. At this point the close valve rocker cam roller 36 is just starting down the decline in the close valve cam lobe 17, and the open valve rocker cam roller 35 is just starting up the incline of the open valve cam lobe 16. At this point, the open valve rocker 19 takes over control of the rocker assembly from the close valve rocker 20. This is because the close valve rocker cam roller 36 begins to float away from the close valve cam lobe 17 (by only a few thousandths of an inch) and at the same time the open valve rocker cam roller 35 begins to experience forced contact with the open valve cam lobe 16. By paying careful attention to the design of the open and close cam lobe profiles, this transition as to which cam lobe is controlling the system is a smooth one.

As the overhead cam continues to turn in the CCW direction, the valve fully open position of FIG. 3B is reached. At this point the open valve rocker cam roller 35 is at the peak of the open valve cam lobe 16. This forces the open valve rocker 19 as far in the CW direction as possible. This is because the contact point of the open valve rocker 19 with the open valve cam lobe 16 is to the right of the open valve rocker shaft 29 about which the open valve rocker 19 rotates. At the farthest most CW rotation of the open valve rocker 19, the open valve rocker retainer arm 37 and roller 38 are in the lowest position possible. Since the valve stem retainer assembly 12, and thus the top of the valve stem 11, are positioned by the open valve rocker retainer roller 38, the valve head 9 (shown in FIG. 1) is pushed open as far it can go into the cylinder 5 (also shown in FIG. 1). At this point, the position of the close valve rocker 20 is solely determined by it's gear teeth 32 engaging the gear teeth of the open valve rocker 31. Since the open valve rocker 19 is rotated as far in the CW direction as possible, the close valve rocker 20 has been forcibly rotated as far in the CCW direction as possible. Due to careful design, the close valve rocker cam arm 34 and roller 36, although rotated upward as far as possible, still clear from hitting the backside of the close valve cam lobe 17 by a few thousandths of an inch.

Once again, another key point in the operation of the geared rocker pair is reached when the open valve rocker cam roller 35 just begins to start traveling down the backside of the open valve cam lobe 16. At this instant the close valve rocker cam roller 36 is just starting up the incline of the close valve cam lobe 17. At this point the transfer of control is switched back to the close valve rocker 19 from the open valve rocker 20. The open valve rocker cam roller 35 begins to float away from the open valve cam lobe 16 (by a few thousandths of an inch), while the close valve rocker cam roller 36 begins to be forced upon by the close valve cam lobe 17.

As the overhead cam shaft continues to turn in a CCW direction, the fully closed position of FIG. 3A is again reached. From here, the entire cycle as described above starts all over again. Each time a complete revolution of the overhead cam shaft occurs, the valve is opened and closed.

Since only one geared rocker may control the pair of geared rockers at a time (and thus the valve), careful design attention must be paid to ensure that both valve rocker cam rollers 35 and 36, are not driven by their respective cam lobes 16 or 17 at the same time or an interference will result. When one of the valve rockers is being driven by its associated cam lobe, the other geared rocker must not be. In fact, the other geared rocker that is not being driven from the cam shaft is being controlled by the one that is via the gear teeth found between the two rockers.

At this point a quick discussion of the valve stem retainer assembly 12 is in order. The sole purpose of this assembly is to engage and exactly follow the up and down movement of the open valve rocker retainer roller 38. Very tight tolerances between the hardened retainer top plate 39 and the hardened valve stem cap 40 are required so that there is almost no play in the up and down movement of the open valve rocker retainer roller between the two plates. Approximately one thousandths of an inch or less would be best. The hardened valve stem cap 40 is desirable to prevent the open valve rocker retainer roller 38 from damaging and wearing at the top of the valve stem 11. This way, the tight tolerances discussed above may be better maintained. The top of the valve stem 11 requires some type of notching or alteration so that the keeper 41 may positively retain it during the up and down stroke of the valve. An example of two small groves in the top of the valve stem 11 are shown FIGS. 3A and 3B to suit this purpose. A washer 42 and a nut 43 are used to tighten the keeper 41 firmly against the top of the valve stem 11.

The operational description of a valve system as discussed above applies in an identical fashion whether it is an intake port valve or an exhaust port valve. Although the components for the two ports may be a mirror image of each other as shown in the top view of FIG. 4. they need not be. The identical components (without mirroring them) could be used to operate both the intake and exhaust ports. In the interest of conciseness and length, replicating the entire operating description above twice; once referring to the intake port valve and once again referring to the exhaust port valve has been avoided. This patent is intended to cover both the intake and exhaust valve operation. This patent is also intended to cover multiple intake and exhaust valves per cylinder.

SUMMARY, RAMIFICATIONS, AND SCOPE

As seen by the description and operational discussion presented above, this invention offers many advantages and benefits by replacing the valve spring in internal combustion engines incorporating an overhead cam, and replacing it with a positive operating mechanism which derives it's force directly from the overhead cam shaft at all times. Without the negative liabilities of a valve spring, engines based on this invention will be able to turn at higher speeds and run for longer periods of time before requiring servicing. This invention has the following additional advantages.

- It permits overhead cam internal combustion engines to be upgraded with the new components of this invention using the existing engine block, crankshaft, pistons, and manifolds. This invention is not limited to new production engines, but to all internal combustion engines with an overhead cam.
- It provides enhanced reliability for internal combustion engines. Valve springs are a leading cause of catastrophic engine failure. High performance engines will no longer require constant valve spring replacements.
- It reduces the cost of maintenance of internal combustion engines which are used for competition.
- It enables internal combustion engines to operate at higher sustainable speeds or RPM's. By using positive force derived from overhead cam shaft lobes to open and close the valve, valve floating will no longer occur.
- It increases the efficiency of internal combustion engines by replacing the valve springs with a valve closing mechanism which derives it's force directly from the cam shaft. While opening the valve, the cam shaft will no longer be required to overcome the constant resistance presented by the valve spring.
- The use of an overhead cam eliminates a pair of lifters and pushrods per valve. Fewer components typically results in increased reliability and lower manufacturing costs.

Although the description above contains many specifications, these should not be construed as limiting the scope of the invention but as merely providing illustrations of some of the presently preferred embodiments of this invention. For example, instead of the close valve rocker shown in FIG. 5B having an extended width gear design in order to engage the gear teeth of the open valve rocker shown in FIG. 5A, it could easily be the other way around. The open valve rocker of FIG. 5A could have the extended gear teeth design, and the close valve rocker of FIG. 5B could have the narrow gear teeth equal to the width of the rest of the rocker. Also, a number of variations to the valve stem retainer assembly 12 could easily be used instead of the version shown here. For example, a pin could go through the top of the valve stem and into some type of keeper that is around the top of the valve stem. Perhaps a roller at the end of the open valve rocker 19 is not required at all, since simply using a flexible pin between the top of the valve stem and the end of the open valve rocker arm would work in some cases. The point is that there are many methods that could be used to retain the top of the valve stem to the end of the open valve rocker arm, and this patent should not be limited to any particular one. Also, the position of the open valve rocker relative to the close valve rocker is very flexible. With some minor redesign, the open valve rocker could just as easily be located to the left of the close valve rocker arm. Additionally, both valve rockers could be located differently with respect to the overhead cam. For example, they could be to the left or right of it. Such movement would require very little redesign, since the operational principles would remain the same as the particular implementation shown in the drawing figures.

Additionally, the overhead cam may indirectly actuate the pair of geared rockers. In this similar embodiment some means of transferring energy from the overhead cam to the individual geared rockers would exist such as: pins, shafts, levers, or connecting rods. Another variation which could easily be implemented would be to have the cam shaft move in a CW direction rather than a CCW direction. In this case, the operation as described above would be identical.

All of the components of this invention do not have to be made of hardened tool steel as the original evaluation model was. Any material which proves to be durable and wear resistant enough to provide adequate performance would do. For example, titanium, and some ceramics may work perfectly well. Also, combinations of materials would suffice such as using hardened steel only at locations of contact and mild steel or aluminum for the majority of the components volume.

While a preferred embodiment of the invention has been presented and described, it will be appreciated that there is no intent to limit the invention by such disclosure. Rather, the disclosure is intended to cover all modifications and alternate embodiments falling within the spirit and the scope of the invention as defined in the appended claims.

I claim:

1. A valve operating mechanism in an overhead cam internal combustion reciprocating piston engine which eliminates the use of a valve spring comprising:

a) a valve;

b) a pair of geared rockers for each valve whose gears are mutually engaged, wherein the movement of said geared rockers is interdependent and wherein each of said rockers reciprocate on a respective shaft so as to control an opening and closing operational cycle of said valve;

c) a retaining mechanism located at an end of one of said geared rockers which engages at the top end of said valve stem to provide a means of connectivity between said geared rockers and said valve throughout the operational cycle;

d) a cam shaft located in the cylinder head area next to said pair of geared rockers which incorporates two different cam lobes per valve, wherein one lobe provides the energy required for valve closing, and the other lobe provides the energy required for valve opening.

2. The valve operating mechanism of claim 1, wherein said pair of geared rockers and cam lobes are arranged into a valve opening set of members and a valve closing set of members, wherein each set contains one member of each pair, and the design of each set is such that one set opens the valve, and the other set closes the valve.

3. The valve operating mechanism of claim 1, wherein a surface of said other cam lobe provides the positive force required to open said valve, and the surface of said one cam lobe provides the positive force required to close said valve in such a manner that only one of said cam lobes in a pair provides positive upward force at a time.

4. The valve operating mechanism of claim 1, wherein each of said geared rockers includes a roller assembly to engage said respective cam lobe.

5. The valve operating mechanism of claim 1, wherein said valve operating mechanism modify an existing engine whereby many components from the existing engine may be reused with minor modifications.

6. A valve operating mechanism in an overhead cam internal combustion reciprocating piston engine comprising:

a) a pair of geared rockers for each valve whose gears are engaged with one another, wherein the movement of said geared rockers is interdependent, and each of said rockers reciprocate on a shaft so as to control an opening and closing of said valve;

b) a pair of cam lobes per valve, the lobes are located on a cam shaft which is next to said geared rockers, wherein one of said cam lobes provides the energy to open the valve, while the other cam lobe provides the energy to close the valve.

7. The valve operating mechanism of claim 6, further including a retaining mechanism which attaches one of said geared rockers to a stem of said valve to control said valve during both the valve opening and closing operations.

8. The valve operating mechanism of claim 6, wherein one member from each of said cam lobe and geared rocker pairs form a set which function together to open the valve, and the other member from each of said component pairs form a set which function together to close the valve, wherein only one of the sets controls the position of said valve at a time.

9. The valve operating mechanism of claim 6, wherein said valve operating mechanism modify an existing overhead cam engine whereby many components from the existing engine may be reused with minor modifications.

* * * * *